United States Patent [19]

Südbeck

[11] 4,417,857

[45] Nov. 29, 1983

[54] PISTON PUMP

[75] Inventor: Rainer Südbeck, Duisburg, Fed. Rep. of Germany

[73] Assignee: Pierburg GmbH & Co. KG, Neuss, Fed. Rep. of Germany

[21] Appl. No.: 338,892

[22] Filed: Jan. 12, 1982

[30] Foreign Application Priority Data

Jan. 27, 1981 [DE] Fed. Rep. of Germany ..... 3102506

[51] Int. Cl.[3] ..... F04B 7/04

[52] U.S. Cl. ..... 417/490; 417/501

[58] Field of Search ..... 417/490, 498, 501, 500

[56] References Cited

U.S. PATENT DOCUMENTS

| | | | |
|---|---|---|---|
| 1,651,670 | 12/1927 | Carrey | 417/501 X |
| 1,760,171 | 5/1930 | Schoene | 417/501 |
| 1,901,817 | 3/1933 | Neidl | 417/498 |
| 2,415,618 | 2/1947 | West | 417/498 |
| 2,595,738 | 5/1952 | Walker | 417/490 X |
| 2,853,229 | 9/1958 | Dölz | 417/490 X |

FOREIGN PATENT DOCUMENTS 1336714 7/1963 France .

*Primary Examiner*—Leonard E. Smith

*Attorney, Agent, or Firm*—Toren, McGeady and Stanger

[57] ABSTRACT

A piston pump, for use for example for operating auxiliary mechanisms in motor vehicles, has a piston 1 which is reciprocated in a cylinder 2 by an eccentric 20 and a return spring 18. The cylinder 2 has an outlet valve 23, and inlet openings 4 in its side wall. Instead of moving the piston 1 so far downwards in the suction stroke of the pump that the piston head 16 is below the inlet openings 4 to allow fluid to flow into the pump chamber 10, the piston is provided with a peripheral groove 13 and openings 11 in its side wall. The openings 11 lead to a recess 17 in the piston head and hence to the pump chamber 10. The groove 13 moves into communication with the inlet openings 4 at two separate times in each to and fro movement of the piston, that is in each pumping cycle, so that the fluid being pumped can only flow into the pump chamber from the inlet openings 4 during these two times. This arrangement provides a more accurate control of the pump output in dependence upon its speed than does the prior arrangement in which the pump chamber 10 is in direct communication with the inlet openings 4 when the piston is at bottom dead-center.

7 Claims, 5 Drawing Figures

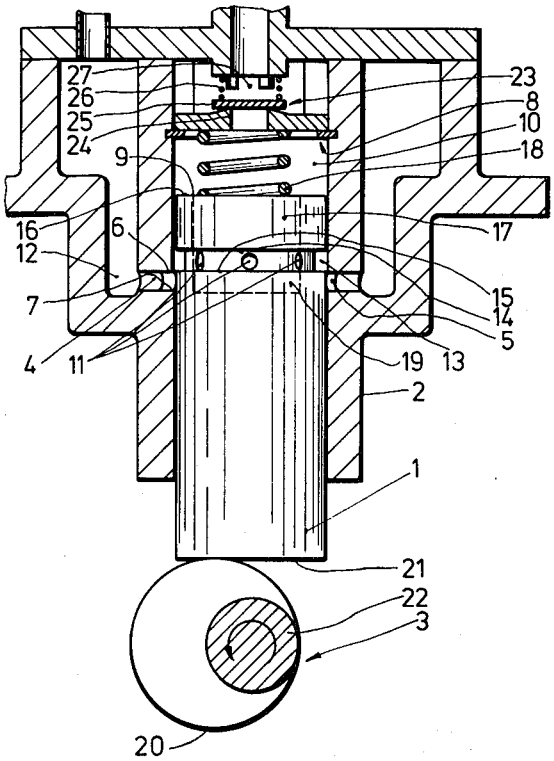

PISTON PUMP

This invention relates to piston pumps which have a controlled delivery rate and comprise a cylinder having one or more inlet openings for the fluid to be pumped in its side wall, an inlet chamber communicating with the upstream side of the inlet opening or openings, a piston having a driving mechanism for reciprocating it in the cylinder, a working chamber between the head of the piston and one end of the cylinder, an outlet valve controlling an outlet leading from the working chamber and a pressure space on the outlet side of the valve.

Pumps of this type are, as a rule, self-priming radial piston pumps for pumping liquids and are frequently used in motor vehicles where they serve, for example, for supplying suspension level regulating devices, servo brakes, servo steering systems, servo clutches, superchargers and other auxiliary hydraulic drives.

Such pumps are described, for example in special publication IAA, 1979, published by the firm of Fichtel & Sachs of Frankfurt. The pistons are preferably driven by an eccentric. When the piston is in the vicinity of bottom dead-centre, a certain quantity of fluid is sucked out of the suction chamber of the pump via lateral inlet openings, for example bores in the cylinder wall. These inlet openings or ports are closed by the piston during the movement of the piston towards top dead-centre and the fluid is delivered via an outlet pressure valve into the pressure chamber of the pump and thence onwards into delivery lines. In such pumps the delivery rate (Q) is downwardly regulated in a loss-free manner as a function of the rotational speed (n) of the pump. To achieve this, as the rotational speed increases and thus the flow velocity of the fluid increases, the fluid reaches, from a certain rotational speed onwards, the region of its limiting velocity, which is dependent upon the pressure difference at the pump. If the rotational speed of the pump increases further, the volume of fluid drawn into the cylinder in each stroke becomes a progressively smaller fraction of the swept volume and thus the delivery rate of the pump is automatically limited. Since the delivery rate under pressure is limited in this way, the pump drive input can also be limited according to the limit of the delivery rate. The downward-regulating range is established by the magnitude of the dead stroke of the pump and also the number and shape of the inlet ports. These pumps operate in a pulsating manner.

Existing pumps of the type initially described have the disadvantage that the delivery characteristics of individual pumps of the same type lie within a relatively broad tolerance band. This has the effect that the maximum delivery rate of the pumps must be set above the required delivery rate by such an amount that even a pump at the lower tolerance limit can reliably still supply the required delivery rate. As a consequence, also, a greater drive input is inevitably required than that which corresponds to the required delivery rate, since even pumps with delivery rates at the upper tolerance limit must be reliably and satisfactorily driven. It is thought that the undesired width of the tolerance band in the delivery of the conventional pumps is caused by the fact that even small tolerances between the position of the upper edge of the piston and the inlet ports when the piston is at bottom dead-centre lead to considerable fluctuations in the delivery rate.

The object of the present invention is to provide a piston pump of the type initially described in which the tolerance band in the delivery rate of pumps which are nominally the same is reduced and a substantially constant delivery rate at a given pump speed is maintained even when the piston, on account of wear of the drive components, changes in its dead-centre positions relative to the inlet openings or openings. As a result the drive energy necessary for driving the pump and producing a given delivery rate is reduced.

To this end, according to this invention, in a piston pump of the type initially described, the piston has one or more passages which open through the side wall of the piston and communicate with the working chamber, the passage or passages moving into communication with the inlet opening or openings at two separate times during each cycle of reciprocating movement of the piston in the cylinder to allow the fluid being pumped to be sucked into the working chamber only at these two separate times.

This surprisingly simple way of achieving the object of the invention is based upon the concept that the opening or openings in the side wall of the piston are not just in flow communication with the inlet opening or openings when the piston is at bottom dead-centre but instead in each pump cycle there is an intake phase the length of which is determined solely by the pump speed both on the downward and also on the upward stroke of the piston. In this way the result is suprisingly achieved that, even with slight deviations in the relative positions of the inlet opening or openings and the opening or openings in the side wall of the piston when the piston is at top or bottom dead-centre, the flow rate per pump cycle remains substantially constant at any given pump speed. Small reductions in the delivery rate due to an opening or openings in the piston being located somewhat too high relative to the inlet opening or openings are, as a rule, automatically eliminated during the running-in of the pump, if the piston is driven by an eccentric, because, due to the running-in a somewhat increased wear initially occurs at the contact surfaces between the eccentric and the piston with the consequence that the range of movement of the piston as a whole drops somewhat in its position relative to the inlet opening or openings. The markedly small dependence of the flow rate upon the aforementioned construction-imposed tolerances of such pumps renders possible a considerable reduction in the set-point delivery rate of all nominally similar pumps to produce a required delivery rate. It is therefore possible to make the set-point delivery rate only slightly higher than the minimum required delivery rate. As a result, moreover, the drive input necessary for such a pump is also reduced to the extent to which the set-point delivery rate approaches the minimum required delivery rate.

An especially precise control of the delivery rate is assured, if as is preferred, the inlet opening or openings lead into an internal circumferential groove in the side wall of the cylinder. A further improvement in this respect is achieved if the passage or passages lead into an external circumferential groove in the side wall of the piston.

The provision of the passage or passages in the piston communicating with the working chamber of the pump is facilitated if a recess which communicates with the or each passage is provided in the head of the piston. In this case, the or each passage through the piston can be made in the form of a radial bore through the side wall of the piston into the aforementioned recess.

Where the driving mechanism includes a return spring which drives the piston downwards and is housed in the working chamber, this spring is disposed according to a preferred feature of the invention between a cylinder head at the one end of the cylinder and the bottom of the recess in the piston. This provides an especially simple guidance of the spring.

According to a further preferred feature of the invention, the outlet valve is spring-loaded and is disposed in the cylinder head. The strength of the spring which is used determines the minimum pressure at which the pump will deliver the fluid.

It is especially advantageous if the driving mechanism includes an eccentric which acts upon the bottom face of the piston. In this way the stroke of the piston can be controlled in a very simple manner.

An example of a pump in accordance with the invention will now be described with reference to the accompanying drawings in which:

FIG. 1 is a diametric section through the pump;

FIG. 2 is a diagram showing the dependence of delivery rate upon the working frequency (rotational speed n) of a conventional piston pump of the type initially described; of an unregulated pump and of a pump in accordance with the invention;

FIG. 3 is a diagram showing the dependence of the delivery rate of a pump in accordance with the invention upon the piston movement for various relative positions of the inlet opening or openings in the cylinder and the opening or openings on the side wall of the piston, with the piston at bottom dead-centre; and FIGS. 4*a* and 4*b* are diagrams similar to FIG. 3 but for conventional pumps of the type initially described.

As shown in FIG. 1, the pump comprises a piston 1 which is moved up and down in a cylinder 2 by a drive 3. The cylinder 2 has a number of lateral inlet openings 4. These are in the form of bores or slits and are situated in the same cross-sectional plane of the cylinder, that is to say the upper and lower edges of the openings are all situated in the same planes across the cylinder. A circumferential internal groove 5 is associated with the inlet openings and this groove has in respect of the axial direction of the cylinder an upper control edge 6 and a lower control edge 7, by which the intake range of the liquid being pumped is sharply cut-off in each direction in respect of the piston movement.

Between a cylinder head 8 and the upper face or head 9 of the piston 1, a working chamber 10 is enclosed within the cylinder 2. The piston 1 has a number of lateral passages 11, which communicates with the working chamber 10 at one end and are located in the axial direction of the piston 1 in such a manner that, in each pump cycle, each passage moves into communication at two separate times with the inlet openings 4 through the groove 5. This means that the inlet openings 4 and the passages 11 are so positioned relative to each other that during each downward movement and each upward movement of the piston a flow communication exists for a certain period, the length of which is dependent on the piston speed, between the working chamber 10 and a suction chamber 12 of the pump. The chamber 12 is disposed outside the cylinder 2 and communicates with the port.

A common circumferential external groove 13 is associated with the lateral passages 11 of the piston. The groove 13 has, in the axial direction of the piston, an upper edge 14 and a lower edge 15. This results in a sharp limitation in the side wall surface of the piston by which the range within which flow communication exists between the working chamber 10 and the suction chamber 12 as the piston moves upwards and downwards.

The passages 11 in the piston 1 communicate with the working chamber 10 through a recess 17 provided in the end face 16 of the piston 1. This recess extends into the piston down at least as far as the plane of the lower edges of the passages 11. The recess is preferably a blind cylindrical bore, in which a spring 18 is seated. The spring 18 bears at one end against the bottom 19 of the recess 17 and at the other end against the cylinder head 8 and causes the downward return movement of the piston 1, after the piston has been moved upwards by an eccentric 20 which acts on a bottom surface 21 of the piston 1. A drive shaft 22 of the eccentric 20 is connected to a rotational drive. The eccentric 20 is preferably formed as a circular disc, which is in continual contact with the bottom surface 21 of the piston 1, so that undesired, shock-like movements of the piston are avoided. With the eccentric 20 constructed as a circular disc, a sinusoidal movement of the piston 1 is produced.

The cylinder head 8 is provided with a spring-loaded outlet valve 23, which consists of a valve seating 24, a valve closure plate 25 and a spring 26 bearing against the plate 25. This valve prevents, in the manner of a non-return valve, backward flow of delivered liquid out of a pressure chamber 27 situated downstream of the valve 23. It is, of course, also possible to position the outlet valve laterally in the cylinder 2 in the upper part of the working chamber 10.

The pump operates in the following manner: with its parts in the positions shown in FIG. 1, the piston 1 is moving downwards; the outlet valve 23 is closed; the lower edge 15 of the external groove 13 of the piston 1 is situated exactly at the level of the upper control edge 6 of the internal groove 5 in the cylinder 2. During further downward travel of the piston, the liquid to be pumped can flow out of the suction chamber 12, through the inlet openings 4 in the cylinder 2 and the passages 11 in the piston 1, into the working chamber 10. The inflow of the liquid occurs because a vacuum has developed in the working chamber 10 during the downward movement of the piston 1 that has already taken place, and the chamber contains vapour having a pressure equal to the partial pressure of the liquid being pumped. With further downward movement of the piston 1, the cross-section of the flow communication first increases and then decreases and is finally cut off when the upper edge 14 of the external groove 13 of the piston 1 reaches the lower control edge 7 of the internal groove 5 of the cylinder 2. This situation is preferably reached at bottom dead-centre of the piston movement (BDC). During the succeeding upward movement, the aforementioned flow communication is made in the reverse sequence again for a period which usually is of the same length as in the downward movement. During this period also further liquid flows into the working chamber 10. Not until the lower edge 15 of the external groove 13 of the piston 1 has again reached the upper control edge 6 of the internal groove 5 of the cylinder 2, does the filling operation of the working chamber end. During the further upward movement of the piston 1, the vapour bubbles of the liquid in the working chamber 10 produced by cavitation first collapse; subsequently, the liquid which has flowed in is pressurised by further upward movement of the piston and is delivered until the piston has reached the top dead centre (TDC). From this point onwards, the piston 1 again descends and thus completes one pumping cycle.

The cross-sections of the inlet openings 4 in the cylinder 2 and of the passages 11 in the piston 1 determine to a certain extent the quantity of liquid that can be delivered in one pumping cycle. The openings and passages may be bores or narrow slits disposed around a circular surface. If the operating frequency of the pump is increased, then in the case of an unregulated pump as can be seen from FIG. 2, the delivery rate would continually increase with increasing rotational speed. Since, however, for the regulated pumps of the type initially described, a limiting velocity of the delivered liquid between the suction chamber 12 and the working chamber 10 is reached from a specific rotational speed onwards, a further increase in rotational speed does not lead to any further rise in the delivery rate of the pump. The aforementioned limiting velocity is also determined substantially by the pressure difference between the suction chamber 12 and the pressure chamber 27 of the pump. In this manner a loss-free regulation or control of the delivery rate is obtained.

If the arrangement of the passages 11 of the piston 1 relative to the inlet openings 4 of the cylinder 2 is so chosen that, at the bottom dead centre of the piston 1, the flow communication has just been closed again the graph a shown in FIG. 3 for the delivery rate Q as a function of the cycle angle $\varphi$ of the piston movement is obtained. If, by contrast, the intake openings 4 are disposed somewhat higher in relation to the aperture 11, the graph b is obtained. As can be seen, the areas beneath the graphs a and b for one pump cycle, which represent the total delivered volume of liquid, are of the same magnitude. If, however, the inlet openings 4 are somewhat lower in relation to the passages 11, then the curve c results. In this case, also, a total delivery rate of almost the same magnitude is obtained, provided that the inlet port 4 is not displaced too far downwards. It is here that the advantage of the invention is to be found, which consists mainly in that, even where the arrangement of the inlet openings in the cylinder and of the passages in the piston relative to each other are not quite precise, the delivery rate is not substantially influenced.

The delivery characteristic of the pump of this invention is indicated in FIG. 2 by the letters o, s and u. Reference u denotes the lower limiting value below which the delivery rate must not fall, and which coincides with the minimum quantity which the pump must deliver. Reference s denotes the set-point of the pump delivery rate, while o represents the upper limiting value. Deviations in the relative positions of the inlet openings in the cylinder and of the passages in the piston from the set-point position (corresponding to curve a in FIG. 3) lead to the deviations in the delivery output represented by the three aforementioned graphs in FIG. 2. By the arrangement in accordance with this invention, the resultant tolerance band of pumps in accordance with the invention becomes exceedingly narrow in comparison with conventional pumps of the type initially described. In the conventional pumps, the flow communication between the suction chamber and the working chamber of the pump, is made only once during a pump cycle, over the bottom dead-centre of the piston. Relative displacements between the piston upper edge which exposes the inlet openings in the cylinder and the position of the inlet openings have the effect that the delivery rates of such pumps deviate substantially from one another, as can be seen from the curves a', b', c' and a'', b'', c'' in FIGS. 4*a* and 4*b*. In FIG. 4*a* circumstances are illustrated, in which the set-point delivery (a') is achieved when the upper edge of the piston at bottom dead centre has exposed the inlet openings, for example by one quarter. By contrast, FIG. 4*b* shows circumstances in which the set-point delivery (a'') is reached when the upper edge of the piston at bottom dead centre has just entirely exposed the inlet port. The curves b' and b'' respectively represent conditions in which the inlet openings are situated somewhat higher than their theoretical position, whereas curves c' and c'' correspond respectively to positions of the inlet ports below the theoretical level.

On account of the pronounced dependence of the delivery rates of conventional reciprocating pumps of the type initially described upon the tolerance of the relative positions of the piston setting and the inlet openings, the set-point delivery rate in these pumps must be made relatively high, so that in the case of minus tolerances the delivery rate will still not fall below the minimum required. FIG. 2 shows correspondingly at o; s' and u' the very wide tolerance band of delivery rate resulting from existing pumps of the type described. It can be seen that this band must lie with its average value inevitably higher than s, for which reason the existing pumps require more driving energy on average, because with them a greater delivery rate of liquid must be pressurised. The hatched area bounded by the curves s and s' in FIG. 2 corresponds therefore to the average energy saving which is achieved by the pumps of the present invention.

Further advantages of pumps in accordance with the invention become especially evident when they are driven by an eccentric and when wear occurs at the contact surfaces of the eccentric and the bottom face of the piston, so that during the course of a long period of operation relative displacement takes place between the theoretical positions of the piston passages and the inlet openings. Within the existing pumps, an energy-consuming increase in the delivery output was thereby regularly produced, whereas with pumps in accordance with this invention in just the same case the delivery output remains very uniformly constant, and the further advantage is attained that, if a minus deviation in delivery output occurs due to a slight error in relative position between the inlet openings 4 and the passages 11, this can be compensated after a running-in period of the pump if the eccentric 20 and the bottom face 21 of the piston have developed a clearance between them.

I claim:

1. In a piston pump having a controlled delivery rate, said pump comprising a pump cylinder including a side wall, means defining at least one fluid inlet opening in said side wall, means defining an inlet chamber communicating with said at least one inlet opening upstream thereof, a piston in said cylinder, said piston including a side face, a driving mechanism operative to reciprocate said piston in said cylinder, said cylinder and said piston defining a working chamber between said piston and one end of said cylinder, a fluid outlet valve and means defining a pressure space on the outlet side of said valve, the improvement comprising means defining at least one piston opening in said side face of said piston and means defining at least one passage communicating said at least one piston opening with said working chamber, said at least one piston opening being so located that said at least one piston opening is moved into communication with said at least one inlet opening at two separate times during each cycle of reciprocating movement of said piston in said cylinder to allow fluid being pumped to be sucked from said at least one inlet opening into said working chamber only during said two separate times.

2. A pump as claimed in claim 1, further comprising means defining an internal circumferential groove in said side wall of said cylinder, said at least one inlet opening being situated in said internal circumferential groove.

3. A pump as claimed in claim 1, further comprising means defining an external circumferential groove in said side face of said piston, said at least one passage leading into said external circumferential groove.

4. A pump as claimed in claim 1, in which said piston includes a piston head and means defining a recess in said piston head, said at least one passage communicating with said recess.

5. A pump as claimed in claim 4, in which said driving mechanism includes a return spring, said return spring acting between said one end of said cylinder and the bottom of said recess.

6. A pump as claimed in claim 1, in which said cylinder includes a cylinder head at said one end thereof, said fluid outlet valve being mounted in said cylinder head, and further comprising spring means biasing said fluid outlet valve to a closed position.

7. A pump as claimed in claim 5, in which said driving mechanism further includes eccentric means acting on an end of said piston remote from said piston head.

* * * * *